US006869044B2

(12) United States Patent
Geswender et al.

(10) Patent No.: US 6,869,044 B2
(45) Date of Patent: Mar. 22, 2005

(54) MISSILE WITH ODD SYMMETRY TAIL FINS

(75) Inventors: Chris Eugene Geswender, Tucson, AZ (US); Shawn Brent Harline, Tucson, AZ (US); George A. Blaha, Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 10/444,653

(22) Filed: May 23, 2003

(65) Prior Publication Data

US 2004/0232278 A1 Nov. 25, 2004

(51) Int. Cl.[7] ..... F42B 10/00

(52) U.S. Cl. ..... 244/3.29; 244/3.28; 244/3.27; 244/3.1; 244/3.23

(58) Field of Search ..... 244/3.29, 3.23, 244/3.24, 3.1, 3.28

(56) References Cited

U.S. PATENT DOCUMENTS 3,177,809 A * 4/1965 Russell-French ..... 244/3.29
4,076,187 A * 2/1978 Metz ..... 244/3.23
4,522,356 A * 6/1985 Lair et al. ..... 244/3.15
4,752,052 A * 6/1988 Galvin ..... 244/3.29
5,029,773 A * 7/1991 Lecat ..... 244/3.28
5,323,987 A * 6/1994 Pinson ..... 244/3.16
5,439,188 A * 8/1995 Depew et al. ..... 244/3.21
6,126,109 A * 10/2000 Barson et al. ..... 244/3.28
6,392,213 B1 * 5/2002 Martorana et al. ..... 244/3.1
6,443,391 B1 * 9/2002 Malejko et al. ..... 244/3.24
6,571,715 B1 * 6/2003 Bennett et al. ..... 102/439
6,695,252 B1 * 2/2004 Dryer ..... 244/3.28

FOREIGN PATENT DOCUMENTS

WO WO 02/06761 A1 * 1/2002

* cited by examiner

*Primary Examiner*—Michael J. Carone
*Assistant Examiner*—R Palabrica
(74) *Attorney, Agent, or Firm*—Renner, Otto, Boisselle & Sklar, LLP

(57) ABSTRACT

A missile, either a powered missile or an unpowered projectile, includes a freely-rolling tail assembly having an odd number of fins. Having an odd number of fins may reduce oscillations caused by the rotation of the freely-rotating tail. This may make a more stable platform for a seeker, such as an uncooled focal point array or other imaging infrared (IIR) or millimeter wave radio frequency (MMW) seeker, in the body of the missile. Also, minimizing oscillation by using an odd number of fins may facilitate control of the missile.

25 Claims, 2 Drawing Sheets

MISSILE WITH ODD SYMMETRY TAIL FINS

BACKGROUND OF THE INVENTION

1. Technical Field

The invention relates to powered and unpowered missiles having freely rolling tails.

2. Description of the Related Art

Guided missiles and projectiles have previously utilized simple gimbaled semi-active laser (SAL) terminal seekers for guidance to a target or other desired location. SAL seekers provide some measure of guidance, while maintaining loose requirements in terms of induced pointing errors, errors due to undesired changes in orientation of the seeker. More recently, imaging infrared (IIR) and millimeter wave radio frequency (MMW) seekers have been employed. Among these new types of seekers are uncooled focal point array seekers, which are a type of IIR seeker. Such new seekers may reduce cost, weight, power requirements and/or complexity. However, they may have longer signal integration times, and may indeed have requirements for stability that are a factor of ten more stringent than with older types of seekers, such as SAL seekers.

It will be appreciated that improved stability would be desirable in missile platforms for unaided autonomous acquisition devices such as IIR and/or MMW seekers.

SUMMARY OF THE INVENTION

According to an aspect of the invention, a guided powered or unpowered missile has a freely rollable tail with an odd number of fins.

According to another aspect of the invention, a guided missile includes a body; and a tail assembly coupled to the body. At least part of the tail assembly is rotatable relative to the body. The tail assembly has an odd number of fins.

According to yet another aspect of the invention, an unpowered guidable projectile includes a body; and a tail assembly coupled to the body. The body includes a seeker; a gimbal to which the seeker is mounted; and canards. At least part of the tail assembly is freely rotatable relative to the body. The tail assembly has an odd number of fins.

According to a further aspect of the invention, a tail assembly for a guidable projectile, includes a base fixedly connected to the body; a fin retainer; an odd number of fins coupled to the fin retainer; and a bearing assembly coupled to the base and the fin retainer. The bearing assembly enables substantially free rotation of the fin retainer relative to the base.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, which are not necessarily to scale.

DETAILED DESCRIPTION

A missile, either a powered missile or an unpowered projectile, includes a freely-rolling tail assembly having an odd number of fins. Having an odd number of fins may reduce oscillations caused by the rotation of the freely-rotating tail. This may make a more stable platform for a seeker, such as an uncooled focal point array or other imaging infrared (IIR) or millimeter wave radio frequency (MMW) seeker, in the body of the missile. Also, minimizing oscillation by using an odd number of fins may facilitate control of the missile.

Figure 1:
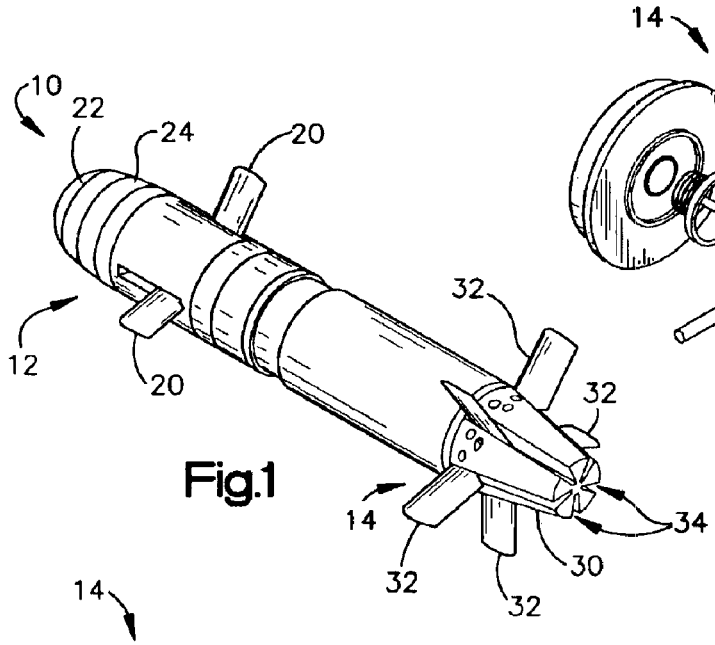
FIG. 1 is a view of a missile in accordance with the present invention.

Referring initially to FIG. 1, a missile 10 includes a forward body 12 coupled to an aft rolling tail assembly 14. The term "missile", as used herein, is intended to encompass both thrust-producing and unpowered devices. Thus, the missile 10 may either be an unpowered projectile, for example, fired from a gun or other launcher, or alternatively may be a powered missile, for example, containing a rocket motor, jet engine, or other thrust-producing device.

The forward body 12 includes canards 20, as well as a seeker 22 mounted on a gimbal 24. The canards 20 are used for controlling orientation and course of the missile 10. Thus, the canards 20 may be coupled to other devices in the body 12, for example, an inertia measuring unit and actuators to aid in determining the course of the missile 10, and the proper positioning for the canards 20 in guiding that course. The canards 20 may be stowed within slots in the forward body 12 at the time of launch or firing of the missile 10, with the canards 20 being deployed by any of a variety of well-known methods. For example, the canards 20 may be hinged and may be deployed through the action of pressure within a launch tube. Alternatively, the canards 20 may be deployed by other forces, such as inertia forces. A mechanism may be provided for locking the canards 20 in a deployed configuration.

The seeker 22 may also be operatively coupled to the canards 20, with the seeker 22 maintaining acquisition of a target or desired destination point, and the canards 20 configured to put the missile 10 on a course for reaching its desired destination. The seeker 22 operates by remaining pointed or otherwise acquiring a desired target or other destination point. Alternatively, the seeker 22 may acquire a point other than an intended destination, but which aids in guidance of the missile 10 to its intended destination. The seeker 22 is mounted on a gimbal 24 to allow the seeker 22 to move as relative orientation between the missile 10 and the target or destination changes.

The seeker 22 may be any of a variety of known terminal seekers. Two broad categories of terminal seekers are imaging infrared (IIR) seekers and millimeter wave radio frequency (MMW) seekers. A subcategory of IIR seekers are uncooled focal point arrays. IIR and MMW seekers offers advantages in terms of weight, complexity, and/or cost, when compared to other types of terminal seekers. However, IIR and MMW seekers may have relatively large acquisition times. For example, an uncooled focal point array may take a relatively large time to integrate optical energy. The acquisition times of IIR and MMW seekers may be in excess of one millisecond, in excess of ten milliseconds, or about sixteen milliseconds. Further information uncooled focal point arrays and IIR seekers may be found in commonly-assigned U.S. Pat. No. 6,144,030, which is hereby incorporated by reference in its entirety. Further information MMW seekers may be found in commonly-assigned U.S. Pat. No. 6,100,841, which is hereby incorporated by reference in its entirety. In addition to the broad categories of seekers mentioned above, it will be appreciated that any of a wide variety of seekers may be utilized with the fin configuration described below, including both gimbaled (such as described below) and body-fixed (tail assembly not free to rotate relative to the body) configurations.

It will be appreciated that the forward body 12 may include other types of components other than those mentioned above. For example, the forward body 12 may include a payload, such as a suitable munition. In addition, the forward body 12 may include communication devices for actively or passively communicating with remote tracking and/or guidance devices, for example.

Figure 2:
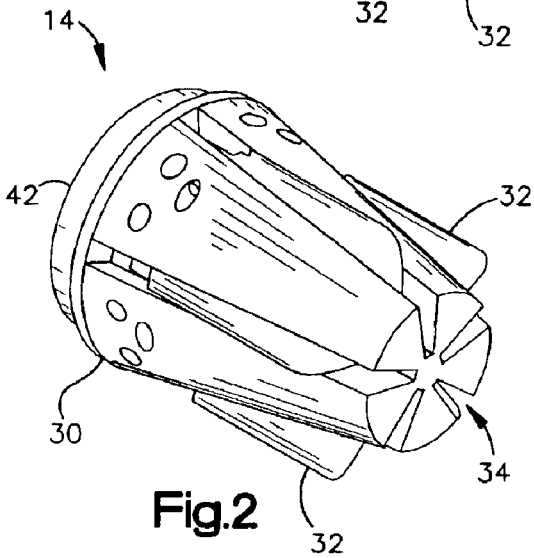
FIG. 2 is a view of the tail assembly of the missile of FIG. 1, with the fins of the tail assembly in a pre-deployed or undeployed configuration.
Figure 3:
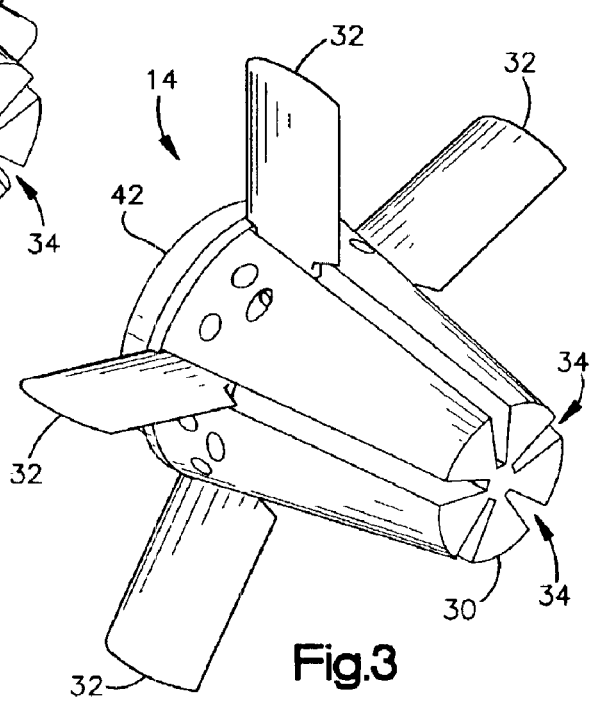
FIG. 3 is another view of the tail assembly of the missile of FIG. 1, with the fins of the tail assembly in a deployed configuration.

The tail assembly 14 includes a fin retainer 30, and an odd number of fins 32 circumferentially spaced about the fin retainer 30. The fin retainer 30 has fin slots 34 corresponding to respective of the fins 32. The fins 32 may be deployed during flight, using mechanisms such as those described above with regard to deployment of the canards 20. FIG. 2 illustrates the tail assembly 14 with the fins 32 in their pre-deployed configuration, and FIG. 3 illustrates the fins 32 in their deployed configuration. A mechanism may be provided for locking the fins 32 into place once deployed.

Figure 4:
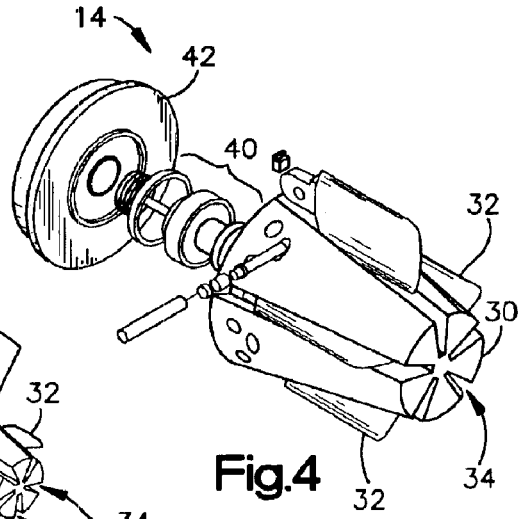
FIG. 4 is an exploded view of the tail assembly of the missile of FIG. 1.

Referring now in addition to FIG. 4, the tail assembly 14 includes a bearing assembly 40. The tail assembly 14 is a freely-rotating assembly, allowing the fin retainer 30 and the fins 32 to rotate freely relative to the forward body 12. More precisely, the fin retainer 30 and the fins 32 freely rotate relative to a base 42 of the tail assembly 14, which in turn is attached to the forward body 12. A rolling tail such as that in the tail assembly 14 is utilized in order to simplify the roll control of the missile 10. Turbulence off the canards 20 causes a roll moment in the fins 32. If the tail is fixed relative to the forward body, the canards must be made large enough to control this roll moment. This would result in smaller-than-optimum fins, reducing lift of the missile, or larger-than-optimum canards, increasing drag and/or control complexity. The solution is to make the tail freely rolling, for example using the bearing assembly 40 shown in FIG. 4. The freely-rolling tail largely obviates the need to provide roll control.

However, a freely-rolling tail will tend to rotate at some small rate, for example, on the order of a few Hertz. This rolling of the free-rolling tail causes a wobbling through the missile 10. This is because as the fin retainer 30 and the fins 32 rotate, the fins 32 change their orientation relative to the angle of attack or apparent wind direction of the missile 10. This causes variations in the drag and/or lift characteristics of the missile 10. This wobbling may be difficult or impossible to fully remove using the gimbal 24. Therefore, the wobbling generated by motion of the fin retainer 30 and the fins 32 may cause difficulties in maintaining acquisition of the seeker 22 on the target or other destination. These problems are particularly acute when seekers with large signal integration times are utilized.

Figure 5:
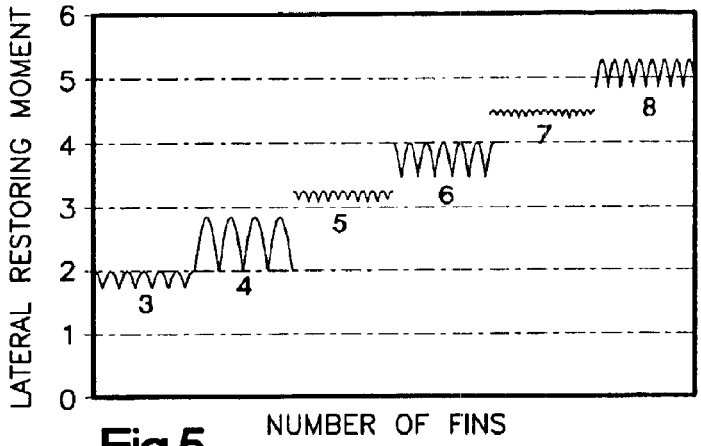
FIG. 5 is a graph showing auto and restoring moments of tails with various numbers of fins.
Figure 6:
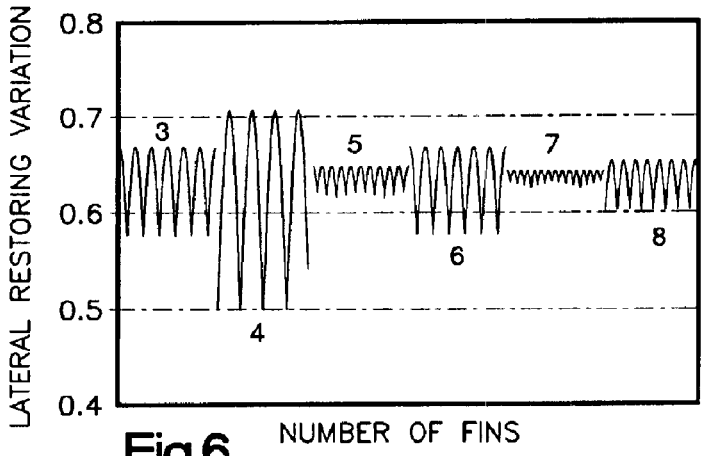
FIG. 6 is a graph highlighting restoring moment variations for tails with various numbers of fins.
Figure 7:
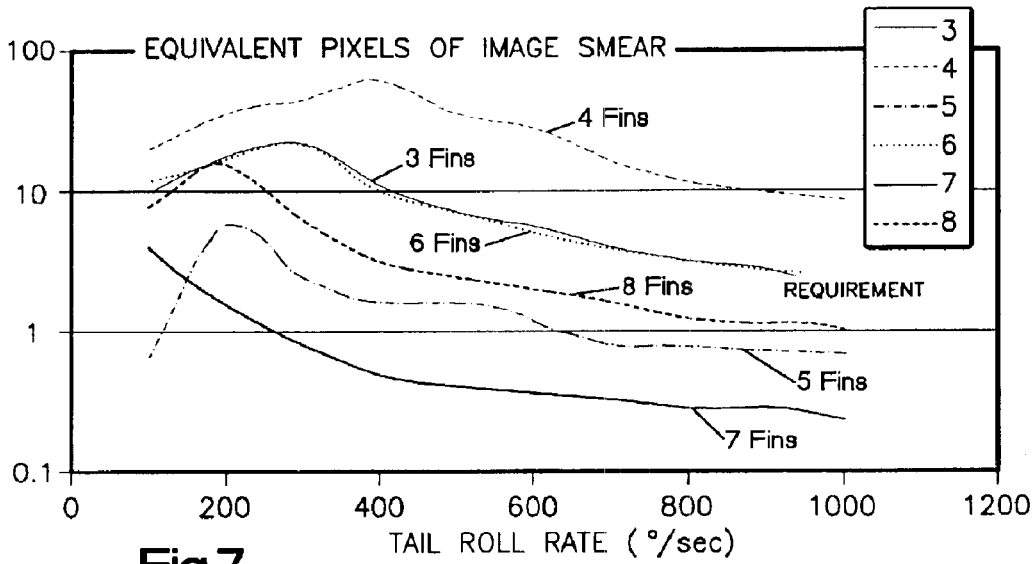
FIG. 7 is a graph of equivalent pixels of image smear vs. tail roll rate for missiles for various numbers of tail fins.

FIG. 5 illustrates an example of the lateral restoring moment (in arbitrary units) as a function of the number of fins of the tail. As expected, a greater number of fins provides a greater lateral restoring moment. However, with reference now in addition to FIG. 6, it will be seen that having an odd number of fins, such as in the missile 10 illustrated in FIGS. 1–4, decreases the variation in restoring moment as the freely-rolling tail rotates. For example, a tail having five or seven of the fins 32 experiences markedly less variation in restoring moment than tails having four, six or eight fins. FIG. 7 shows an example of the equivalent pixels of image smear, due to the gimbal 24 incompletely removing the time oscillation of the forward body 12, as a function of the number of the fins of a freely-rolling tail. As can be seen from FIG. 7, the lowest amount of image smear occurred with configurations having five or seven fins.

Thus, the missile 10, with its odd number of the fins 32, produces less moment variation (wobbling) than traditional designs having even numbers of fins. The reduction in wobbling allows better image acquisition by the seeker 22. The missile 10 may have five fins, may have seven fins, or may have an odd number of fins greater than seven.

In addition to providing a more stable platform for the seeker 22, utilizing an odd number of fins may advantageously enhance guidance of the missile 10. It will be appreciated that a reduction in oscillatory motion may enhance the accuracy of readings from inertia measuring units that measure rotation rate and acceleration, and/or may reduce control-system-generated movements of the canards 20, thus, for example, reducing the amount of power utilized by the control system.

Use of an odd number of the fins 32 may allow use of larger fins while still enabling control of the missile 10 by the canards 20. For example, a tail span of the tail assembly 14 (the diameter of a circle swept out by the fins 32 may be greater than a canard span of the missile 10 (the tip-to-tip diameter of the canards 20).

The odd-symmetric fin configuration (an odd number of fins symmetrically spaced about a tail assembly) described above may offer additional advantages beyond those already mentioned. For example, the configuration may offer increased range relative to similar missiles with even-symmetric fin configurations.

The use of an odd symmetry tail such as that described above thus allows a more efficient air vehicle by minimizing the number of surfaces needed to generate lift while at the same time reducing possible oscillatory motion compared to corresponding missiles with even numbers of fins. In addition to the advantages of providing a more stable platform for the seeker 22, and the other possible advantages discussed above, the missile 10 with its odd number of the fins 32 may have a larger range than corresponding missiles with even numbers of fins.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A guided missile comprising:

a body; and a tail assembly coupled to the body;

wherein at least part of the tail assembly is freely rotatable as a unit about a central longitudinal axis of the missile, such that the at least part of the tail assembly rotates unpowered and uncontrolled, relative to the body;

wherein the tail assembly has an odd number of substantially planar fins;

wherein the at least part of the tail assembly includes the fins; and wherein the substantially planar fins are substantially co-planar with an axis of the at least part of the tail assembly.

2. The missile of claim 1, wherein the body includes a seeker.

3. The missile of claim 2, wherein the seeker includes an imaging infrared (IIR) seeker.

4. The missile of claim 3, wherein the IIR seeker includes an uncooled focal plane seeker.

5. The missile of claim 2, wherein the seeker includes a millimeter wave radio frequency (MMW) seeker.

6. The missile of claim 2, wherein the seeker has an acquisition time greater than about 1 millisecond.

7. The missile of claim 2, wherein the body also includes a gimbal to which the seeker is mounted.

8. The missile of claim 1, wherein the tail assembly has five fins.

9. The missile of claim 1, wherein the tail assembly has at least seven fins.

10. The missile of claim 1, wherein the tail assembly has at least nine fins.

11. The missile of claim 1, wherein the fins are deployable in flight.

12. The missile of claim 1, wherein the fins are circumferentially evenly spaced around the tail assembly.

13. The missile of claim 1, wherein the tail assembly includes:

a base fixedly connected to the body;

a fin retainer to which the fins are connected; and a bearing assembly coupled to the base and the fin retainer; and wherein the bearing assembly enables substantially free rotation of the fin retainer relative to the base.

14. The missile of claim 13, wherein the fin retainer has slots therein corresponding to each of the fins, with the fins within the slots when the fins are in a stowed position.

15. The missile of claim 1, wherein the body includes canards.

16. The missile of claim 15, wherein a canard span of the canards is less than a tail span of the tail.

17. The missile of claim 1, wherein the missile is powered.

18. The missile of claim 1, wherein the missile is an unpowered projectile.

19. An unpowered guidable projectile comprising:

a body, wherein the body includes:

a seeker;

a gimbal to which the seeker is mounted; and canards; and a tail assembly coupled to the body;

wherein at least part of the tail assembly is freely rotatable as a unit about a central longitudinal axis of the missile, such that the at least part of the tail assembly rotates unpowered and uncontrolled, relative to the body;

wherein the tail assembly has an odd number of fins;

wherein the at least part of the tail assembly includes the fins; and wherein the substantially planar fins are substantially co-planar with an axis of the at least part of the tail assembly.

20. The projectile of claim 19, wherein a canard span of the canards is less than a tail span of the tail.

21. A guided missile comprising:

a body, wherein the body includes:

a seeker;

a gimbal to which the seeker is mounted; and canards; and a tail assembly coupled to the body, wherein the tail assembly includes:

a base fixedly connected to the body;

a fin retainer to which the fins are connected; and a bearing assembly coupled to the base and the fin retainer;

wherein at least part of the tail assembly is freely rotatable as a unit about a central longitudinal axis of the missile, such that the at part of the tail assembly rotates unpowered and uncontrolled, relative to the body;

wherein the tail assembly has an odd number of fins; and wherein the fins are circumferentially evenly spaced around the tail;

wherein the fin retainer has slots therein corresponding to each of the fins, with the fins within the slots when the fins are in a stowed position; and wherein the at least part of the tail assembly includes the fins and the fin retainer.

22. The projectile of claim 21, wherein a canard span of the canards is less than a tail span of the tail.

23. The missile of claim 19, wherein the fins are circumferentially evenly spaced around the tail.

24. The missile of claim 13, wherein the fins are circumferentially evenly spaced around the tail.

25. The missile of claim 24, wherein the at least part of the tail assembly also includes the fin retainer.

* * * * *